US006152113A

United States Patent [19]

Yi

[11] Patent Number: 6,152,113

[45] **Date of Patent: *Nov. 28, 2000**

[54] HIGH-PRESSURE INJECTOR FOR A DIESEL ENGINE

[75] Inventor: Seyoung Yi, Kyungki-do, Rep. of Korea

[73] Assignee: Hyundai Motor Company, Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/986,486

[22] Filed: Dec. 8, 1997

[30] Foreign Application Priority Data

Dec. 6, 1996 [KR] Rep. of Korea ..... 96-62522

[51] Int. Cl.[7] ..... F02M 37/04

[52] U.S. Cl. ..... 123/499; 417/466; 92/60.5

[58] Field of Search ..... 123/497, 498, 123/499; 239/533.6, 585.1; 417/416, 417, 466; 92/60.5, 165 RP

[56] References Cited

U.S. PATENT DOCUMENTS

| | | | |
|---|---|---|---|
| 2,859,741 | 11/1958 | Glenn | 123/497 |
| 3,380,387 | 4/1968 | Kofink | 417/417 |
| 3,387,562 | 6/1968 | Voit | 92/60.5 |
| 4,308,475 | 12/1981 | Haeck | 417/417 |
| 4,919,102 | 4/1990 | Iwabuchi | 123/499 |
| 5,044,900 | 9/1991 | Cavallaro | 417/466 |
| 5,630,401 | 5/1997 | Binversie | 417/417 |
| 5,779,454 | 7/1998 | Binversie | 123/498 |

FOREIGN PATENT DOCUMENTS

| | | | |
|---|---|---|---|
| 257956 | 10/1948 | Switzerland | 92/60.5 |

*Primary Examiner*—Carl S. Miller
*Attorney, Agent, or Firm*—Christie, Parker & Hale, LLP

[57] ABSTRACT

A high-pressure fuel injector of a diesel engine includes a nozzle body, a pressure chamber body and a pressure piston. The nozzle body has a cavity in a central region thereof and a closed top end formed integrally thereon, the nozzle body includes a solenoid assembly integrally mounted at an upper side; a fuel feeding passage formed through the nozzle body at a side, the fuel feeding passage having a fuel feeding port communicating with the cavity; and at least one of injection passages formed through the nozzle body at a side, the injection passage having fuel outlet ports communicating with the cavity. The pressure chamber body is able to move up and down in the nozzle body to increase secondly the pressure of a trapped fuel therein, which includes an inlet port formed at a side thereof for selectively communicating with the fuel feeding port; and at least one of outlet ports formed at a side thereof for selectively communicating with the fuel outlet ports. The pressure piston disposed within the moving means and fixed on the closed top end of the nozzle body through a pressure rod.

18 Claims, 3 Drawing Sheets

HIGH-PRESSURE INJECTOR FOR A DIESEL ENGINE

FIELD OF THE INVENTION

The present invention relates to a fuel injector for a diesel engine and, more particularly, to a high-pressure fuel injector which can increase secondly injection pressure of the fuel being pressurized firstly in a fuel pump to spray it into a combustion chamber.

BACKGROUND OF THE INVENTION

The main purpose of a diesel fuel injector is to direct and atomize the metered fuel into a combustion chamber.

In a conventional fuel injector, a needle valve is disposed in the nozzle formed in a fuel injector. Fuel trapped in the nozzle is delivered into the combustion chamber according to up-down motion of the needle valve being controlled by a solenoid. Therefore, an operation time of the solenoid relates to a lift duration of the needle valve, determining the amount of fuel injected into a corresponding combustion chamber.

The trend in recent times is to make the nozzle as small as possible and increase the injection pressure to spray the fuel in more minute droplets and minimize the amount of fuel being injected during ignition delay timing such that fuel injection amounts can be better controlled and combustion efficiency can be improved.

However, the prior art fuel injector for diesel engines has a drawbacks in that there is a limit to minimize the injection fuel, since it is designed to simply supply the fuel pressurized only by the fuel pump to the combustion chamber by opening the nozzle hole.

SUMMARY OF THE INVENTION

Therefore, the present invention has been made in an effort to solve the above described problems. It is an object of the present invention to provide a high-pressure fuel injector for a diesel engine which can further increase the injection pressure of the fuel that is firstly pressurized by a fuel pump such that combustion efficiency is improved, fuel consumption reduced, and emissions minimized.

To achieve the above object, the present invention provides a high-pressure fuel injector of a diesel engine for supplying fuel from a fuel pump to a combustion chamber, comprising:

- a nozzle body having a top end and a bottom end, the nozzle body comprising:
  - a cavity in a central region of the nozzle body;
  - a fuel feeding passage for receiving fuel firstly pressurized by the fuel pump, the fuel feeding passage having an outlet port opened to the cavity at a first height;
  - an injection passage having a port opened to the cavity at a second height; and
- means for receiving the firstly pressurized fuel through the fuel feeding passage, for secondly pressurizing the firstly pressurized fuel, and for injecting the secondly pressurized fuel to the combustion chamber through the injection passage, said means being disposed within the cavity.

According to a preferred embodiment of the present invention, said means comprises: a pressure chamber body slidably disposed within the cavity of the injector body, the pressure chamber body defining a pressure chamber and having a first port selectively communicating with the outlet port of the fuel feeding passage and a second port selectively communicating with the port of the injection passage; a piston assembly, part of which is disposed within the pressure chamber; and an actuator for displacing the pressure chamber relative to the piston, whereby the firstly pressurized fuel is secondly pressurized and the secondly pressurized fuel is selectively injected to the combustion chamber.

Preferably, the first height is than the second height.

Preferably, the actuator comprises a solenoid assembly disposed within the cavity around the pressure chamber body.

Preferably, the piston assembly comprises a pressure piston disposed within the pressure chamber and a pressure rod having a first end fixed to the piston and a second end fixed to the top end of the nozzle body.

Preferably, the pressure rod comprises means for adjusting a position of the pressure piston relative to the pressure chamber body.

The adjusting means comprises a cross groove formed on a top surface of the second end of the pressure rod.

BRIEF DESCRIPTION OF THE DRAWINGS

These and other features, aspects, and advantages of the present invention will be more fully understood when considered with respect to the following detailed description, appended claims, and accompanying drawings, wherein:

DETAILED DESCRIPTION OF THE PREFERRED EMBODIMENTS

Reference will now be made in detail to the present invention, examples of which are illustrated in the accompanying drawings. Wherever possible, the same reference number will be used throughout the drawings to refer to the same or like parts.

Figure 1:
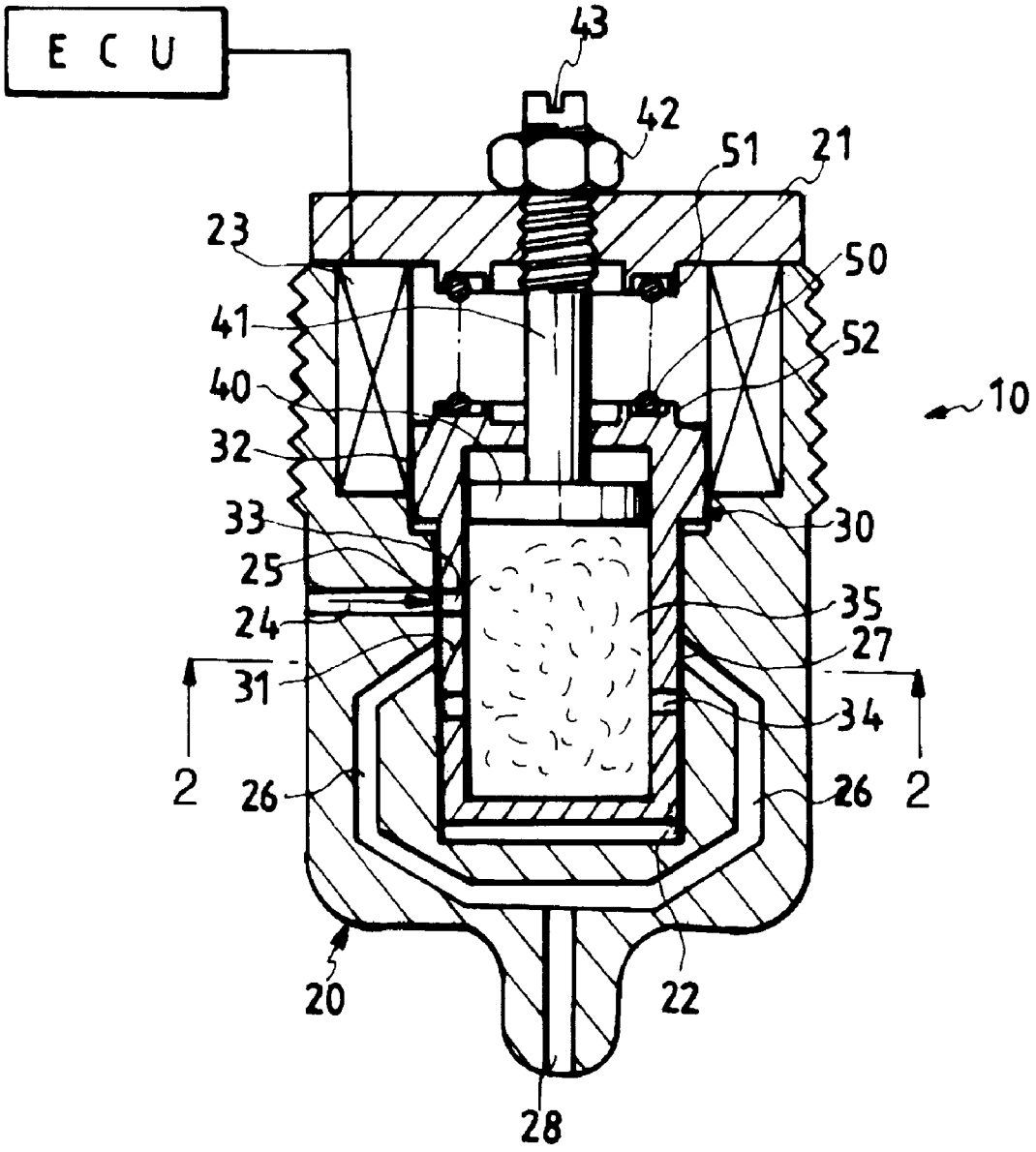
FIG. 1 is a semi-schematic, cross-sectional side view showing a state in which a high-pressure fuel injector according to a preferred embodiment of the present invention is supplied with the fuel from a fuel pump through an inlet port.

Referring first to FIG. 1, there is shown a semi-schematic, cross-sectional side views showing fuel inhalants state of a preferred embodiment of a high-pressure fuel injector 10 for a diesel engine provided in accordance with practice of the present invention. The positioning and orientation of the components of the high-pressure fuel injector 10 relative to each other are described below as they are shown in the drawings.

The high-pressure fuel injector 10 comprises an nozzle body 20, a pressure chamber body 30 defining a pressure chamber 35 therein and disposed within the nozzle body 20, a pressure piston 40 disposed within the pressure chamber 35, and an elastic member 50 disposed between a closed top end 21 of the nozzle body 20 and the pressure chamber body 30.

The nozzle body 20 is generally fixed on a cylinder head (not shown) and has a cavity 22 in a central region thereof for providing a space in which the pressure chamber body 30 is axially and movably disposed. The closed top end 21 is integrally formed on the nozzle body 20 to enclose the cavity 22. The cavity 22 has a cylindrical-shape having an upper portion and a lower portion whose diameter is less than that of the upper portion.

The high-pressure fuel injector 10 further comprises a solenoid assembly 23 integrally mounted within the nozzle body 20 around the pressure chamber body 30. A fuel feeding passage 24 is formed through a side of the nozzle body 20 such that fuel can be fed from a fuel tank (not shown) to the pressure chamber 35 therethrough. Injection passages 26 are formed in the nozzle body 20 to inject the pressurized fuel within the pressure chamber 35 into the combustion chamber (not shown). The solenoid assembly 23 is connected to an electronic control unit (ECU) and controlled by it.

More in detail, the fuel feeding passage 24 is opened to the cavity 22 through a fuel feeding port 25. The injection passages 26 are also opened to the cavity 22 through fuel outlet ports 27. The injection passages 26 are converged at a portion extending to an injection port 28 through which the pressurized fuel is sprayed into the combustion chamber.

The pressure chamber body 30 is axially slidable with respect to the nozzle body 20 in response to the operation of the solenoid assembly 23. The pressure chamber body 30 is formed in a cylindrical shape having small and large diameter portions 31 and 32 which are corresponding to the lower and upper portion of the cavity 22. The pressure chamber body 30 is provided at its small diameter portion 31 with an inlet port 33 formed at an upper part thereof to selectively communicate with the fuel feeding port 25 and outlet ports 34 formed at a lower part thereof to selectively communicate with the fuel outlet ports 27.

Figure 2:
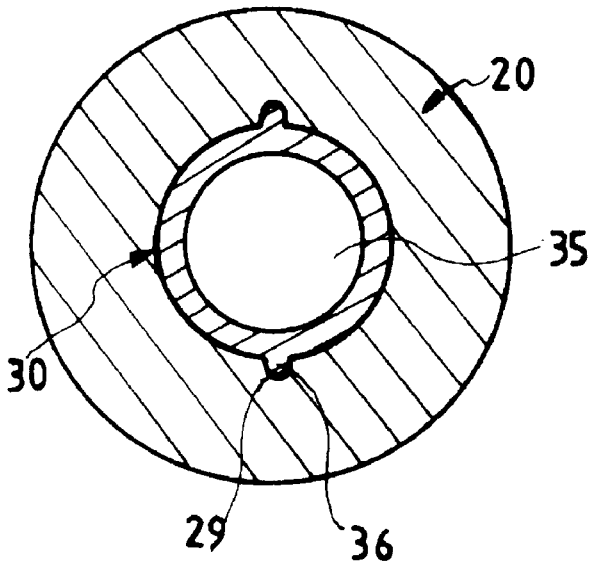
FIG. 2 is a sectional view taken along line I—I of FIG. 1.

Preferably, as shown in FIG. 2, the high-pressure fuel injector 10 is provided with guide grooves 29 formed on an wall of the nozzle body 20 defining the cavity 22 and guide projections 36 formed on outer surface of the pressure chamber body 30. The pressure chamber body 30 is disposed in the cavity 22 such that the guide projections 36 are inserted into the guide grooves 29, thereby restricting the rotation of the pressure chamber body 30 with respect to the nozzle body 20. This ensures the ports 25, 27 formed in the nozzle body 20 to coincide with the ports 33, 34 of the pressure chamber body 30 when the pressure chamber body 30 is axially displaced.

A pressure rod 41 is fixed to the pressure piston 40 disposed within the pressure chamber 35 and extends out of the pressure chamber 35 to be screwed on the closed top end 21 by a nut 42. A cross groove 43 is formed on the head 43 of the pressure rod 41 so that a degree of the fuel pressure in the pressure chamber 35 can be controlled by adjusting the position of the pressure piston 40 relative to the pressure chamber body 30.

The elastic member 50 is made of a spring disposed between a spring seat 51 formed on the bottom side of the closed top end 21 and a spring seat 52 formed on the upper side of the pressure chamber body 30.

The operation of the above described high-pressure fuel injector 10 will be described hereinafter more in detail.

When the ECU controls the solenoid assembly 23 such that the pressure chamber body 30 is displaced by biasing force of the elastic member 50 to a position as shown in FIG. 1, the fuel feeding port 25 in the nozzle body 20 is in line with the inlet port 33 of the pressure chamber body 30. Accordingly, the fuel pressurized firstly by a fuel pump (not shown) is fed from the fuel pump into the pressure chamber 35 through the fuel feeding passage 24 so that the inside of the pressure chamber 35 is filled with a metered amount of fuel.

In this state, when the electronic control unite (ECU) controls the solenoid assembly 23 according to operating condition of the engine (not shown) such that the pressure chamber body 30 is forced upward while overcoming the biasing force of the elastic member 50, the pressure piston 40 is displaced downward relative to the pressure chamber body 30. As a result, the pressure of the fuel trapped within the pressure chamber 35 is automatically increased since the volume of the pressure chamber 35 is reduced as the pressure chamber body 30 is forced upward relative to the pressure piston 40.

Figure 3:
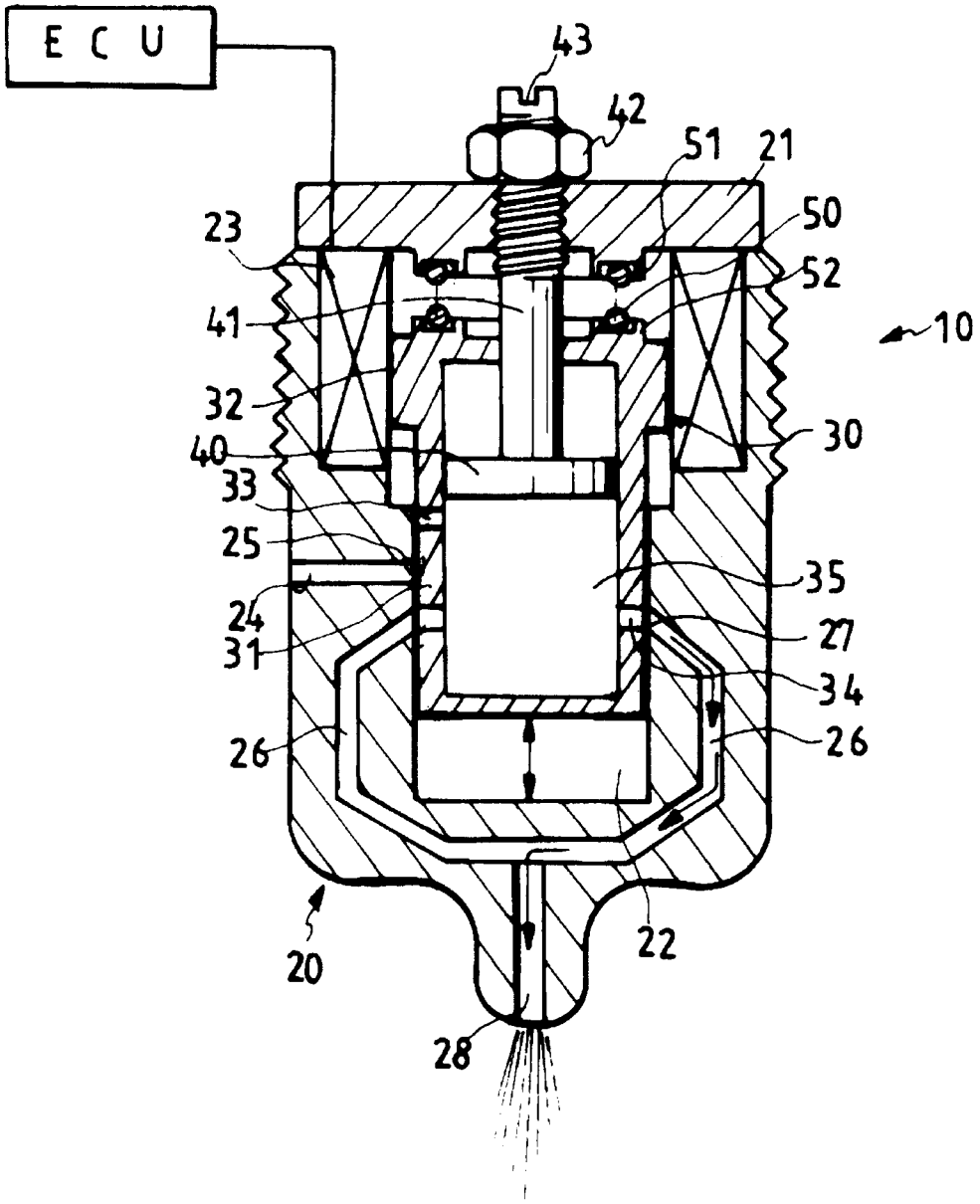
FIG. 3 is a semi-schematic, cross-sectional side view showing a state in which a high-pressure fuel injector injects fuel into the combustion chamber.

When the outlet port 34 in the pressure chamber body 30 is in line with the fuel outlet ports 27 of the injection passage 26 as the pressure chamber body 30 is displaced upward, the further pressurized fuel within the pressure chamber 35 is forced out into the combustion chamber in a spray pattern through the injection passage 26 (See FIG. 3).

After injecting the further pressurized fuel into the combustion chamber, the electronic control unite (ECU) controls the solenoid assembly 23 such that the pressure chamber body 30 returns from the elevated position to its original position by the biasing force of the elastic member 50.

When the inlet port 33 of the pressure chamber body 30 is in line with the fuel feeding port 25 in the nozzle body 20, fuel is fed from the fuel pump to the pressure chamber 35 for a next cycle.

In the present invention, a degree of the fuel pressure being pressurized in the pressure chamber 35 can be controlled by adjusting the position of the pressure piston 40 relative to the pressure chamber body 30. The adjustment can be realized by spinning the head 43 of the pressure rod 41 using a driver.

As described above, the high-pressure fuel injector according to the present invention additionally pressurizes the fuel previously pressurized by the fuel pump so that the injected fuel is more atomized and supplied in a more high pressurized state, thereby improving combustion efficiency, reducing fuel consumption, and minimizing emissions.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A high-pressure fuel injector of a diesel engine for supplying fuel from a fuel pump to a combustion chamber, comprising:

a nozzle body having a top end, the nozzle body comprising, a cavity in a central region of the nozzle body, a fuel feeding passage at a side of the cavity for receiving fuel firstly pressurized by the fuel pump, the fuel feeding passage having an outlet port opened to the cavity at a first height, and an injection passage having a port opened to the cavity at a second height;

a pressure chamber body disposed within the cavity of the nozzle body, the pressure chamber body defining a pressure chamber and having a first port selectively communicating with the outlet port of the fuel feeding passage and a second port selectively communicating with the port of the injection passage;

a piston forming an end wall of the pressure chamber; and an actuator for displacing the pressure chamber body relative to the piston, whereby the firstly pressurized fuel is secondly pressurized and the secondly pressurized fuel is selectively infected to the combustion chamber.

2. A high-pressure fuel injector of claim 1, wherein the first height is higher than the second height.

3. A high-pressure fuel injector of claim 1, wherein a position of the first port is higher than that of the sceond port.

4. A high-pressure fuel injector of claim 1, wherein the actuator comprises a solenoid assembly disposed within the cavity around the pressure chamber body.

5. A high pressure fuel injector of claim 1 further comprising a rod having a first end fixed to the piston and second end coupled to the top of the nozzle body.

6. A high-pressure fuel injector of claim 5, wherein the second end is screw-coupled on the top end of the nozzle body.

7. A high-pressure fuel injector of claim 6, wherein the pressure rod comprises means for adjusting a position of the pressure piston relative to the pressure chamber body.

8. A high-pressure fuel injector of claim 7, wherein the adjusting means comprises a cross groove formed on a top surface of the second end of the pressure rod.

9. A high-pressure fuel injector of a diesel engine, comprising;

a nozzle body having a cavity formed in a central region of the nozzle body and a closed top end formed integrally on the nozzle body, the nozzle body comprising:

a solenoid assembly integrally mounted adjacent the top end;

a fuel feeding passage formed through the nozzle body at a side, the fuel feeding passage having a fuel feeding port communicating with the cavity;

at least one injection passage formed through the nozzle body at a side, the at least one injection passage having a fuel outlet port communicating with the cavity;

a pressure chamber body within the cavity;

an inlet port formed at a side of the pressure chamber body for selectively communicating with the fuel feeding port;

an outlet port formed at a side of the pressure chamber body for selectively communicating with the fuel outlet port;

a pressure piston disposed within the pressure chamber body wherein the pressure chamber body and piston define a pressure chamber, wherein the piston forms an end wall of the pressure chamber; and a rod coupled to the piston and to the nozzle body.

10. A high pressure fuel injector of claim 9, wherein the pressure rod the rod is adjustably coupled to the nozzle body, wherein the length of the rod between the piston and the nozzle body can be adjusted thereby adjusting the position of the piston relative to the pressure chamber body.

11. A high-pressure fuel injector of claim 9 further comprising at least one guide groove formed on a wall of the nozzle body and at least one guide projection formed on an outer surface of the pressure chamber body to thereby restrict the rotation of pressure chamber body relative to the nozzle body such that the ports formed in the nozzle body coincide with the ports of the pressure chamber body when the pressure chamber body is axially displaced.

12. A fuel injector of a diesel engine for supplying fuel from a fuel pump to a combustion chamber, the fuel injector comprising:

a nozzle body;

a cavity in the nozzle body;

a fuel feeding passage for receiving pressurized fuel from the fuel pump, the fuel feeding passage having a fuel feeding port communicating with the cavity at a first height in the cavity;

an injection passage having a fuel outlet port communicating with the cavity at a second height in the cavity;

a pressure chamber body slidably disposed within the cavity, the pressure chamber body comprising a first port for selective communication with the fuel feeding port, and a second port for selective communication with the fuel outlet port;

a piston disposed at least in part within the pressure chamber body, the piston in combination with the pressure chamber body defining a pressure chamber, wherein the piston forms an end wall of the pressure chamber; and an actuator for moving the pressure chamber body relative to the piston.

13. The fuel injector according to claim 12 wherein the first height in the cavity is higher than the second height in the cavity.

14. The fuel injector according to claim 12 further comprising a rod having a first end coupled to the piston and a second end coupled to the top end of the nozzle body.

15. The fuel injector according to claim 12 wherein the actuator comprises a solenoid around the pressure chamber body, and an electronic control unit operatively coupled to the solenoid.

16. The fuel injector according to claim 14 wherein the piston rod further comprises means for adjusting the position of the piston relative to the pressure chamber body.

17. A fuel injector comprising:

a nozzle body;

a cavity within the nozzle body;

a fuel feeding passage formed on the nozzle body in communication with the cavity;

an injection passage formed on the nozzle body in communication with the cavity;

a pressure chamber body slidably disposed within the cavity, the pressure chamber body comprising a first port for selective communication with the fuel feeding passage, and a second port for selective communication with the injector passage;

a piston disposed at least in part within the pressure chamber body, the piston in combination with the pressure chamber body defining a pressure chamber, wherein the piston forms an end wall of the pressure chamber; and an actuator for moving the pressure chamber body relative to the piston.

18. The fuel injector according to claim 17 wherein the piston is adjustably coupled to the nozzle body whereby the position of the piston relative to the pressure chamber body can be adjusted.

* * * * *